United States Patent [19]

Fife et al.

[11] Patent Number: 4,685,031

[45] Date of Patent: Aug. 4, 1987

[54] EDGEBOARD CONNECTOR

[75] Inventors: Robert M. Fife, Attleboro; Dennis Ross, New Bedford; Richard F. Shaw, N. Attleboro, all of Mass.

[73] Assignee: Texas Instruments Incorporated, Dallas, Tex.

[21] Appl. No.: 831,882

[22] Filed: Feb. 24, 1986

[51] Int. Cl.[4] ..... H01R 23/70

[52] U.S. Cl. ..... 361/413; 361/415; 439/325; 439/631; 439/61

[58] Field of Search ..... 339/17 LC, 17 M, 17 L, 339/75 MP, 176 MP, 176 MF; 361/412, 413, 415; 174/68.5

[56] References Cited

U.S. PATENT DOCUMENTS

| | | | |
|---|---|---|---|
| 2,701,346 | 2/1955 | Powell | 361/413 X |
| 2,911,609 | 11/1959 | Burtt et al. | 339/176 MP |
| 2,937,357 | 5/1960 | Kennedy | 339/176 MP |
| 3,020,510 | 2/1962 | Kuch | 361/413 |
| 3,509,520 | 4/1970 | Cobban et al. | 339/176 MP |
| 3,652,899 | 3/1972 | Henschen | 339/176 MP X |
| 3,763,462 | 10/1973 | Ecker | 339/17 L X |
| 3,897,991 | 8/1975 | Pritulsky | 339/75 MP |
| 3,912,353 | 10/1975 | Kasuya et al. | 339/75 MP |
| 3,973,817 | 8/1976 | Stalley et al. | 174/68.5 |

FOREIGN PATENT DOCUMENTS

| | | | |
|---|---|---|---|
| 184297 | 7/1966 | U.S.S.R. | 339/17 L |

*Primary Examiner*—Arthur T. Grimley
*Assistant Examiner*—Jane K. Lau
*Attorney, Agent, or Firm*—James P. McAndrews; John A. Haug; Melvin Sharp

[57] ABSTRACT

An edgeboard connector having a large number of contacts accommodated in a housing cavity is adapted to mount one or more printed circuit boards having lesser numbers of contacts pads and to assure that the contact pads on the boards are electrically engaged with predetermined ones of the connector contacts by attaching one or more detachable members to the housing within the cavity to engage lateral edges of the printed circuit boards as they are inserted into the connector cavity to position the boards in the cavity.

2 Claims, 4 Drawing Figures

EDGEBOARD CONNECTOR

BACKGROUND OF THE INVENTION

The field of this invention is that of edgeboard connectors for mounting printed circuit boards, and the invention relates more particularily to edgeboard connectors having large numbers of contacts adapted to make electrical connection to one or more printed circuit boards each having a relatively lesser number of contact pads.

When edgeboard connectors are mounted on large printed circuit boards to permit a number of smaller printed circuit board units to be detachably mounted on the larger board by being inserted into the connectors, the connectors sometimes have contacts which exactly correspond in number to the contact pads provided at the edges of the smaller circuit board units. In that arrangement, when terminal portions of the connector contacts are soldered to circuit pads on the larger circuit boards and the smaller circuit boards are inserted into the connectors, the contact pads on the smaller units are easily mated with the correct contact means in the connectors. If neccessary, the smaller boards and the connectors sometimes have eccentrically disposed polarizing means such as grooves in the edges of the smaller boards which mate with thin ribs in the connectors only when the smaller boards are inserted into the connectors with the proper orientation of the top and bottom sides of the smaller board units.

However, in many printed circuit board systems, the connectors mounted on the larger circuit board have a much greater number of contacts than are necessary for making electrical connection to the number of contact pads at the edges of the small circuit board units to be mounted in the connector. Sometimes several of the smaller board units such as memory modules or the like are mounted in the same edgeboard connector. In such cases, when certain connector contacts are soldered to particular circuit pads on the larger board and when the smaller board units are inserted into the connectors, the connector contacts may be inadvertantly engaged with other than the intended contact pads on the smaller board units. In that regard, the contact pads are typically arranged at the edges of the smaller board units to have a standardized center-to-center spacing between the pads on the board units and they usually have a standardized end spacing between the lateral edges of the boards and contact pads adjacent to those lateral edges.

SUMMARY OF THE INVENTION

It is an object of the invention to provide a novel and improved edgeboard connector; and to provide an edgeboard connector having a relatively large number of contacts adapted to mount one or more printed circuit board units having a relatively smaller numbers of contact pads with assurance that contact pads on the printed circuit board units are properly mated with predetermined contacts in the connector.

Briefly described, the novel and improved edgeboard connector of this invention is adapted to mount printed circuit board units having any number of contact pads within a selected range where those pads are disposed along a first edge of the board unit. The connector comprises an elongated insulating housing having an elongated cavity and has a plurality of electrical contacts greater in number than said selected range disposed within the housing cavity for electrically engaging the contact pads on a board unit when a first edge of the board unit is inserted into the housing cavity. The connector also includes at least one member which is selectively and detachably attached to the housing within the housing cavity for engaging a lateral edge of the printed circuit board unit to position the unit in the cavity and align the contact pads on the board unit with predetermined contacts in the housing cavity. If desired, several of such detachable members are used to cooperate with ends of the housing cavity in locating several of such smaller circuit board units in the same connector with the pads on each of the smaller board units aligned with and mated with a predetermined group of the connector contacts.

DESCRIPTION OF THE DRAWINGS

Other objects, advantages and details of the novel and improved edgeboard connector of this invention appear in the following detailed description of preferred embodiments of the invention, the detailed description referring to the drawings in which.

DESCRIPTION OF THE PREFERRED EMBODIMENTS

Figure 1:
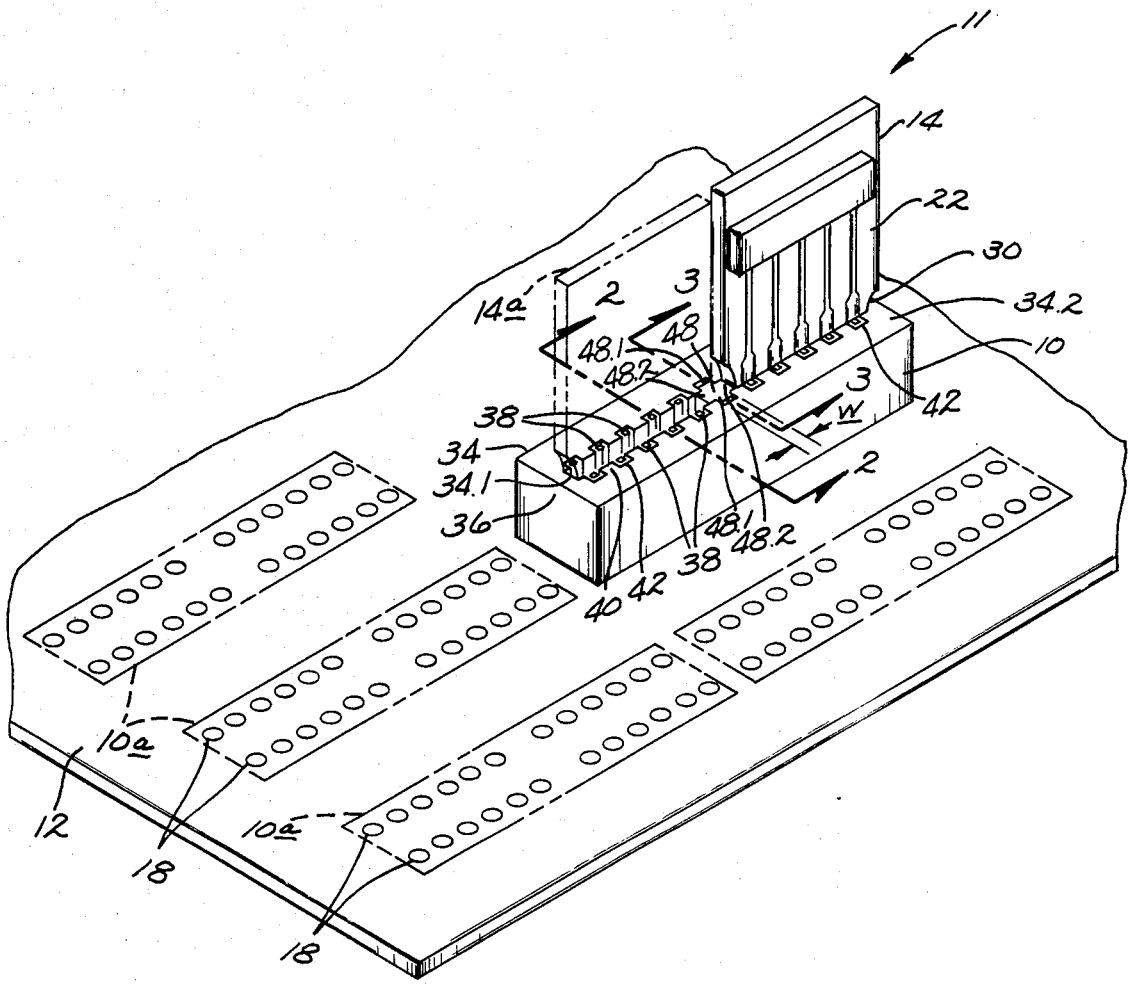
FIG. 1 is a perspective view of the connector of this invention illustrating the connector in a printed circuit board system.

Referring to the drawings, 10 in FIG. 1 indicates the novel and improved edgeboard connector of this invention which is shown in a printed circuit board or panel system 11 comprising a relatively large printed circuit board 12 and a plurality of relatively smaller circuit board units 14. In that system, circuit pads 16 are provided on a bottom side of the relatively large printed circuit board 12 (see FIGS. 2 and 3) and a plurality of openings 18 in the larger board extend from the circuit pads to the top side of the larger board. A plurality of the connectors 10 are mounted on the larger board with connector contacts connected to selected circuit pads 16 through the openings 18 and with one or more of the relatively smaller printed circuit board units 14 mounted in each of the connectors 10 as is further described below. For clarity of illustration, only one connector 10 and one of the smaller board units 14 are illustrated in solid lines in FIG. 1 while locations of other connectors and smaller board units are diagrammatically illustrated by broken lines 10*a* and 14*a*.

Figure 4:
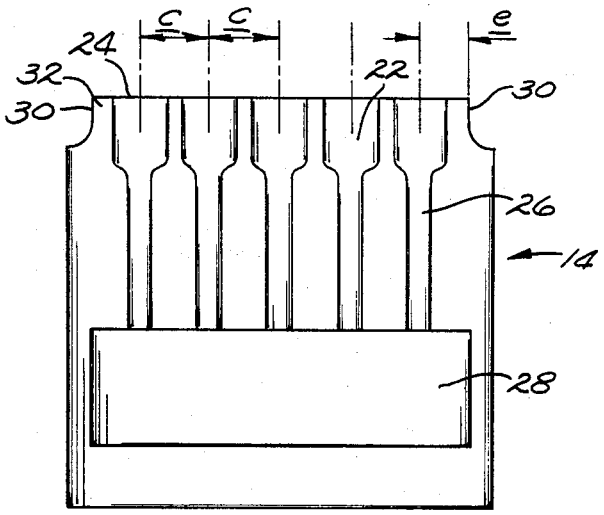
FIG. 4 is a plan view to enlarged scale of a printed circuit board unit to be mounted in a connector of this invention.

The smaller printed circuit board units 14 used with the connectors 10 are of any conventional type within the scope of this invention and typically have a plurality of contact pads 22 arranged in spaced, side-by-side relation to each other along a first edge 24 of the board unit. In some cases, the contact pads 22 are provided adjacent the first board edge on both top and bottom sides of the smaller circuit board unit. The contact pads 22 are electrically connected by circuit paths 26 to electronic components and the like mounted on the smaller boards as is diagrammatically illustrated at 28 in FIG. 4. Typically the contact pads are arranged with a selected, equal, standardized, center-to-center spacing c of 0.100 inches (or 0.125 or 0.156 inches) along the first board dedge and with a selected, equal, standardized, end spacing e of 0.050 (or 0.063 or 0.78) inches between opposite lateral edges 30 of the smaller board units and the centers of those contact pads 22 which are adjacent those lateral board edges. Where a relatively limited number of contact pads are provided on the smaller board units, the pads are typically disposed on a tongue portion 32 of the smaller printed circuit board units 14 to be mounted in the connector 10. Typically include both custom board units and standardized memory modules and the like as will be understood.

In accordance with this invention, the edgeboard connector 10 comprises an elongated electrically insulating housing 34 having an elongated cavity 36 extending along the length of the housing. Preferably the housing is molded of a rigid glass-filled, nylon or polyester material or the like. A plurality of electrical contacts 38 are mounted in the cavity with a selected center-to-center spacing corresponding to the spacing c between contact pads 22 on the smaller circuit board units 14. Preferably also, the portions of the housing 34,1, 34.2, located at opposite ends of the cavity 36 are spaced at a distance corresponding to the end spacing e shown in FIG. 4 from the center line of the contacts 38 adjacent to the cavity ends. In a preferred embodiment, a plurality of lands 40 and grooves 42 are arranged in spaced relation extending along opposite sides of the cavity 36 so that pairs of the grooves 42 are juxtaposed relative to each other on opposite sides of the cavity. The contacts 38 each preferably comprise single beam contact members which are accommodated in respective grooves 42 to be electrically isolated from each other by the lands 40.

Figure 2:
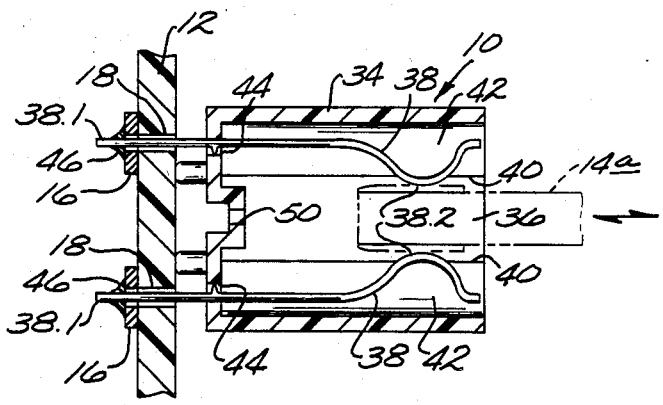
FIG. 2 is a section view to enlarged scle along 2—2 of FIG. 1.
Figure 3:
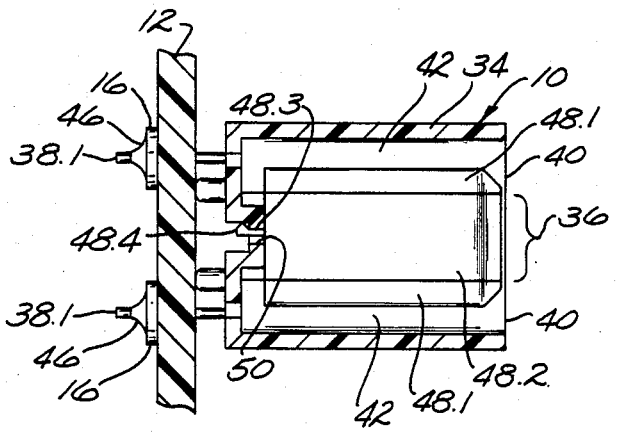
FIG. 3 is a section view to enlarged scale along line 3—3 of FIG. 1.

The contact members have respective posts or terminal portions 38.1 press-fitted into openings 44 formed in the bottom of the insulating connector housing cavity to extend from the housing through openings 18 in the larger circuit boards to be soldered to the circuit paths 16 on the larger board as indicated at 46 in FIG. 2. Each contact also has an opposite, resilient contact end 38.2 which is positioned in the housing cavity 36 to make resilient electrical engagement with a contact pad 22 on one of the smaller circuit board units when the smaller unit is inserted into the housing cavity as is also indicated by dotted lines 14*a* in FIG. 2. As diagrammatically illustrated in FIG. 1, the housing cavity 36 is shown to be relatively much longer than the first edge 24 of one of the small board units 14 so that several of such board units are adapted to be accommodated in a single connector housing. In accordance with this invention, a member 48 is attached to the connector housing 34 within the housing cavity 36 for slideably engaging a lateral edge 30 of a circuit board unit 14 inserted into the cavity, thereby to locate the unit in the cavity to assure that the contact pads 22 on the unit are electrically engaged with predetermined ones of the electrical contacts 38 spaced along the cavity. If desired, the member 48 is molded into the cavity for dividing the connector cavity into predetermined plural sections but preferably the member is detachably attached to the housing within the cavity 36 as shown in FIGS. 1 and 3. In a prefered embodiment, the member has a main part of generally symmetrical, cruciform cross-section as illustrated in FIG. 1 having a selected width w corresponding to the center-to-center spacing c of the contact pads 22 and of the contacts 38 as previously described. In that arrangement, the cruciform section h as two oppositely extending ribs 48.1 fitted into grooves 42 at respective opposite sides of the cavity 36 and has two other oppositely extending ribs 48.2 with a transverse disposition defining the width of the member extending along the length of the cavity 36. The member also has a tang part detachably engaged with detent means in the housing for permitting the member 48 to be detachably attached to the housing at any location along the length of the housing cavity. Preferably for example, the member has a flexible post or tang 48.3 with a barb 48.4 which is deflected in being inserted into a detent opening 50 in the bottom of the connector housing for detachably holding the member in the cavity 36 as shown in FIG. 3. As will be understood, a plurality of openings 50 are spaced along the cavities 36 in alignment with respective grooves 42 and contacts 38 so that the member 48 is adapted to be positioned at any desired location along the length of the cavity. A pair of connector contacts 38 are removed from the connector cavity at the location where the member 48 is located.

In that arrangement, a circuit board unit 14 is easily positioned at the desired location in the connector cavity 36 so that one of the lateral edges 30 of the circuit board units is slidably engaged with member 48 while the opposite lateral edge of the unit preferably engages the housing portion 34.2 at an end of the housing cavity. In that way, the circuit board unit is positioned so that the contact pads 22 on the unit are respectively engaged with the intended contacts 38 in the cavity. Accordingly, when the connector contacts 38 are soldered to circuit paths 16 on the larger circuit boards in the system, the mounting of the smaller circuit board units in the connectors is easily accomplished with assurance that the contact pads 22 on each circuit board unit are electrically connected to intended circuit paths 16 by means of the connector contacts 38. The members 48 are inserted before first insertion of the circuit board units 14 into the connector cavities. Several circuit board units are easily positioned in the same connector cavity separated by a single member 48 as diagrammatically shown in FIG. 1 or several members 48 can be arranged at the various locations in the cavity to hold circuit board units 14 in wider spaced relation to each other in a connector cavity if required.

It should be understood that although particular embodiment of the invention are described by way of illustrating the invention, the invention includes all modifications and equivalents of the described embodiments following within the scope of the intended claims.

We claim:

1. An edgeboard connector for mounting a pair of printed circuit boards each having contact pads equally spaced along a first edge of the board with equal end spacing between lateral edges of the boards and adjacent contact pads at opposite ends of said first board edges, comprising an elongated insulating housing having an elongated cavity in the housing which has a selected length between opposite ends thereof for receiving a first edge of one said of circuit boards therein within a limited portion of the cavity length at an end of cavity and for receiving a first edge of another of said circuit boards therein in another portion of the cavity length, a plurality of electrical contacts disposed in the cavity with selected center-to-center spacing therebetween for electrically engaging respective contact pads on the first edge of said one circuit board within said limited portion of the cavity while leaving other contacts in said other portion of the cavity length free of such engagement for electrically engaging respective contact pads on the first edge of the other of said circuit boards, the housing having portions thereof at opposite ends of the cavity with selected end spacing from contacts adjacent thereto in the cavity for engaging one lateral edge of said one circuit board inserted into the cavity, and a member detachably attachable to the housing within the cavity at a location intermediate the opposite ends of the cavity for engaging an opposite lateral edge of the one printed circuit board so that said engagements with said lateral edges of the one printed circuit board cooperate in assuring that the contact pads on the one board are electrically engaged with precisely predetermined contacts of the connector, wherein the detachable member has a selected width corresponding to the center-to-center spacing of the contacts for engaging respective lateral edges of two of the print circuit boards inserted into the cavity, wherein the detachable member has a tang thereon and the housing has a detent means within the cavity for detachably engaging the member tang to locate the detachable member in any of a plurality of selected locations in the housing cavity to engage a lateral edge of a printed circuit board inserted therein, wherein the insulating housing has a plurality of lands and grooves therein, the grooves being spaced along said housing cavity for accommodating respective contacts therein and the lands being disposed between the grooves for electrically isolating the contacts from each other, wherein the detachable member has a rib portion fitted into a groove for precisely locating the member in a predetermined position in the cavity with the width of the member extending along the length of the cavity, and wherein pairs of said spaced contacts are disposed in juxtaposed relation to each other on opposite sides of the housing cavity, the housing has a plurality of said lands and grooves juxtaposed at said opposite sides of the cavity accommodating and electrically isolating respective contacts from each other at opposite sides of the cavity to electrically engage contact pads on both sides of a printed circuit board inserted into the cavity, and the detachable member has a symmetrical cruciform cross section and has two oppositely disposed parts thereof fitted into respective juxtaposed grooves at opposite sides of the cavity for precisely locating the member in the cavity with two other parts defining the width of the member extending along the length of the cavity to permit more than one printed circuit board unit to be accommodated in the cavity in locating engagement with the detachable member.

2. An edgeboard connector as set forth in claim 1 wherein the housing has a detent opening therein associated with each pair of the contacts mounted in the housing cavity, and the detachable member has a flexible tang releasably received within a selected detent opening for positioning the detachable member in a selected position in the connector housing cavity.

* * * * *